United States Patent [19]

Hitchcock et al.

[11] 4,014,077

[45] Mar. 29, 1977

[54] CLIP

[76] Inventors: Morley Hitchcock, 8846 King Memorial Road, Mentor, Ohio 44060; Maurice A. Lambrix, 6943 Post Lane, Hudson, Ohio 44236

[22] Filed: Oct. 15, 1975

[21] Appl. No.: 622,692

[52] U.S. Cl. ..... 24/67.5

[51] Int. Cl.[2] ..... B42F 1/00

[58] Field of Search ..... 24/259 SH, 67.3, 67.5, 24/67.7, 67.11, 81 PH

[56] References Cited

UNITED STATES PATENTS

| | | | |
|---|---|---|---|
| 1,566,695 | 12/1925 | Raschick | 24/67.3 |
| 1,844,744 | 2/1932 | Critchfield | 24/67.3 X |
| 2,312,436 | 3/1943 | Oldham | 24/67.5 |
| 2,334,380 | 11/1943 | Brinker | 24/67.7 |
| 3,212,146 | 10/1965 | Morgan | 24/67.7 X |
| 3,310,901 | 3/1967 | Sarkisian | 24/67.7 |

FOREIGN PATENTS OR APPLICATIONS

| | | | |
|---|---|---|---|
| 1,089,222 | 9/1954 | France | 24/67.7 |
| 326,244 | 3/1930 | United Kingdom | 24/67.11 |
| 1,293,656 | 10/1972 | United Kingdom | 24/67.7 |

*Primary Examiner*—Donald Griffin

*Attorney, Agent, or Firm*—Woodling, Krost, Granger & Rust

[57] ABSTRACT

The present disclosure relates to the combination of a clipboard, having a clip of plastic material secured to a board. The clip includes a U-shaped one-piece unitary member having first and second sides and a connecting portion interconnecting the two sides. A mounting wall extends laterally outwardly from the first side of the member and has first and second spaced spring retaining grooves. Wall means has rivets extending therethrough to secure the clip to the mounting surface. First and second spaced spring retaining lugs are formed on the second side of the unitary member on the inside surface thereof and a lifting member is formed on the outside surface of the second side of the unitary member to enable the user of the combination to lift the clip to either place paper underneath or to remove paper therefrom. A torsion spring, within the U-shape, has a tongue secured by the spring retaining lugs. The unitary member between the mounting wall and the first side has a thinner section than at other places in the cross section of the generally U-shape so as to permit flexing of the unitary member at this location or position during operation of the clip. The engaging surface of the unitary member in its molded condition and before being attached to the clipboard is located a greater distance from the connecting portion of the U-shape than the mounting wall so that when the clip is secured to the clipboard and the engaging surface and the mounting wall both lie on the same surface, a force is created tending to hold the engaging surface firmly against the mounting surface of the clipboard.

7 Claims, 9 Drawing Figures

CLIP

The present application discloses a new and unique construction of a clip for attachment to conventional clipboards which clip is designed to replace metal clips presently used in the clipboard industry. The specific nature of the clip is that it is essentially constructed of a one-piece unitary member preferably formed by an injection molding process and constructed of a synthetic resin or plastic material. A metal torsion spring is used in the construction to add an additional force in urging the clip into engagement with the clipboard. Rivets or threaded members hold the clip to the clipboard. The present invention discloses a clip with a low profile resulting in a device which is less bulky than prior art devices. The present clip has no exposed metal edges or members and, thus, is quite safe in use.

The clip in its molded position or in its unattached position is formed so that the mounting wall or flange is located closer to the bottom of the U-shape of the device than the lip or engaging surface of the other side of the U-shape. This serves to preload the clip when it is attached to the clip-board and the torsion spring that is utilized with the clip assists in providing the correct tension or force to hold papers and the like on the surface of the clipboard.

The wall of the one-piece unitary plastic member is constructed with a thin section between the main portion of the clip and the mounting flange to provide in effect a "living hinge" which allows the clip to properly flex in its operation. The double torsion spring which is utilized is conveniently located within the confines of the generally U-shape and the free ends of the spring are conveniently contained in grooves or slots on a surface of the mounting flange or member and are retained therein by the mounting surface of the clipboard. The double torsion spring makes a convenient construction for holding the pencil or other writing instrument of a person using the clip and clipboard of the present invention.

Other objects and a fuller understanding of this invention may be had by referring to the following description and claims, taken in conjunction with the accompanying drawings, in which:

Figure 1:
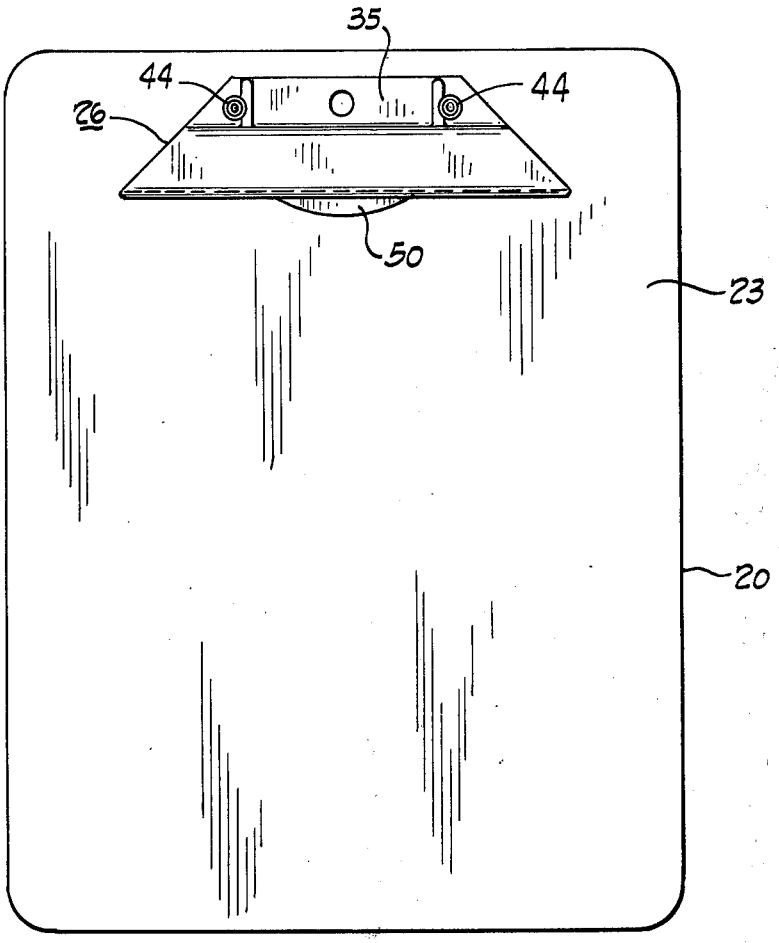
FIG. 1 is a plan view of the clip of the present invention attached to a clipboard.
Figure 2:
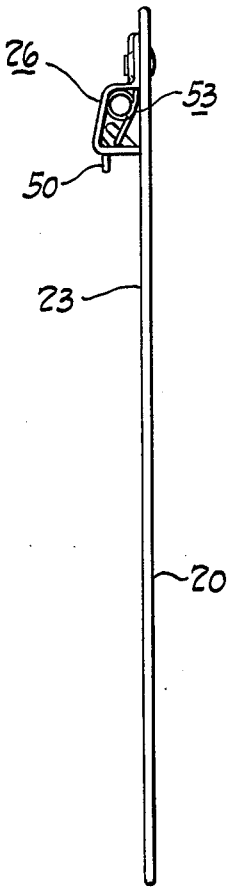
FIG. 2 is an elevational view of the clip attached to a clipboard and taken from the right edge of FIG. 1.
Figure 3:
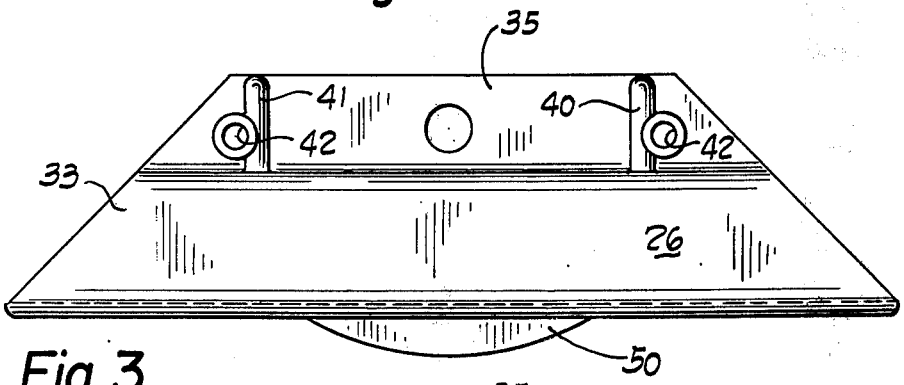
FIG. 3 is an enlarged top plan view of the clip of the present invention.

The combination of the present application includes a clipboard 20 which has a mounting surface 23 and a plastic clip secured to the mounting surface. The plastic clip has been identified generally by the reference numeral 26 and includes a one-piece unitary member having first and second sides 30 and 32, respectively, integrally connected together by a connecting portion 33. It will be noted from the various figures that the first and second sides 30 and 32 and the connecting portion 33 serve to define a generally U-shaped cross sectional configuration. The one-piece unitary member is preferably formed by an injection molding process and is formed of a synthetic resin or plastic material and for the sake of example only, this plastic material may be polypropylene.

Figure 9:
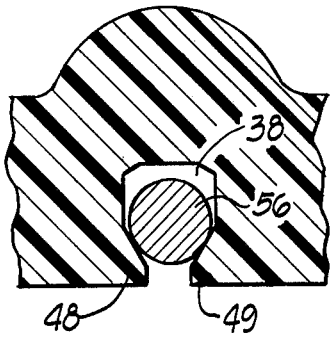
FIG. 9 is a view taken generally along the line 9—9 of FIG. 6.

A mounting wall 35 extends laterally outwardly from the first side 30 and has first and second spaced spring retaining grooves 38 and 39, respectively, extending transversely thereacross. The mounting wall 35 is formed in the injection molding process and is an integral part of the unitary member. Wall means 42 define spaced rivet openings through the mounting wall and rivets 44 or any other equivalent means extend through these openings to secure the clip to the mounting surface 23 of the clipboard 20. The spring retaining grooves 38 and 39 are reinforced on the opposed sides of the surface within which they are formed by means of first and second reinforced portions 40 and 41, respectively. FIG. 9 shows in detail the construction of groove 38 and 39 is identical. The entrance to groove 38 is formed by projections 48 and 49 which make the entrance smaller than the groove proper. The reason for this construction is to keep spring end 56 trapped in the groove prior to attachment of the clip to the clipboard. The normal tendency is for the end 56 to attempt to move out of the groove and the projections 48 and 49 prevent this. Projections 48 and 49 are resilient enough to permit spring end 56 to be forced into the groove.

First and second spring retaining lugs 46 and 47, respectively, are formed on the inside surface of the second side 32 of the unitary member for a purpose which will be described. A lifting member 50 is formed on the outside surface of the second side 32 of the unitary member to enable a user of the clipboard to conveniently engage and lift the clip so as to remove papers or to place papers within the confines of the clip.

A double torsion spring 53 is confined within the U-shape of the unitary member and has first and second free ends 56 and 57, respectively, and a tongue or interconnecting portion 60. The first and second free ends 56 and 57 of the spring 53 reside in the first and second spring retaining grooves 38 and 39 and are held therein by the mounting surface 23 of the clipboard closing the grooves 38 and 39. The interconnecting portion or tongue 60 of the spring is located over or secured by the first and second retaining lugs 46 and 47. The end of the second side 32 of the unitary member is provided with what has been identified as an engaging surface 64 which is for the purpose of engaging paper or other articles located on the mounting surface 23 of the clipboard. The two loops of spring 53 are capable of holding a pencil and a tab 75 is adapted to engage a pencil to assist in holding the same.

Figure 6:
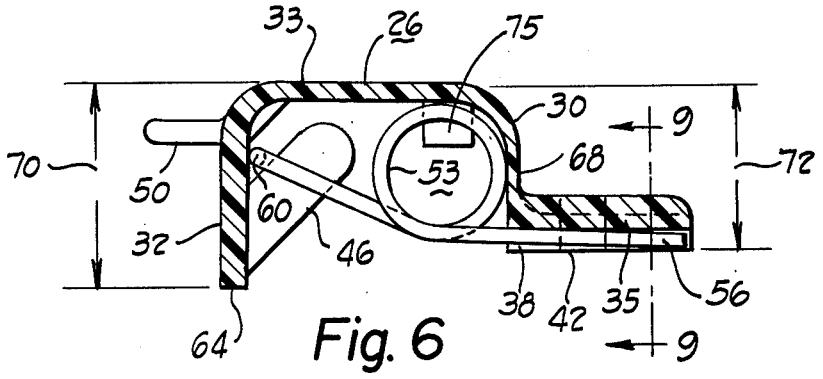
FIG. 6 is an enlarged sectional view of the clip of the present invention and showing the clip before attachment to a clipboard or in its molded condition.
Figure 7:
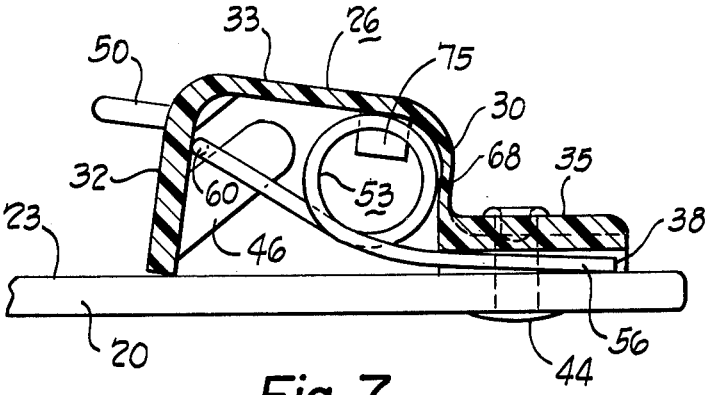
FIG. 7 is a view similar to FIG. 6 but showing the position of the clip as attached to a clipboard.
Figure 8:
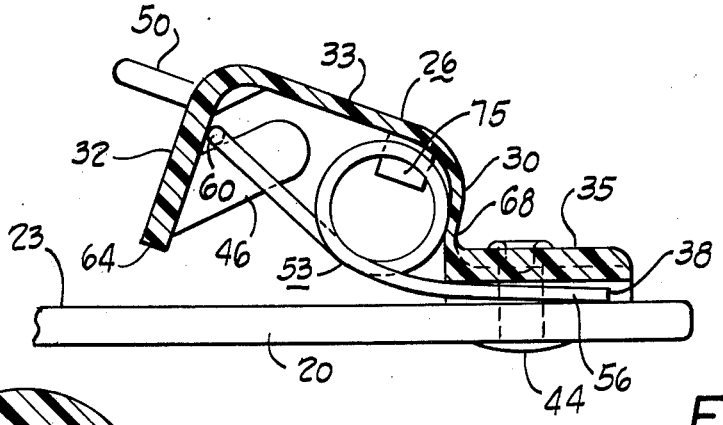
FIG. 8 is a view similar to FIGS. 6 and 7 and showing the clip raised from the surface of the clipboard in position to receive papers or similar items to be held.

The cross section of the unitary member is illustrated in the drawings and particularly in FIGS. 6, 7 and 8. It will be noted that the cross section of the unitary member between the mounting wall 35 and the first side 30 is provided with a thin section 68, which is thinner than the cross section at (FIG. 8) of the unitary member at this particular location or position during operation of the clip. This thin section 68, because of the nature of the thickness of the section and its particular location with respect to the mounting wall, provides what has been at times referred to herein as a living hinge. This hinge is made of the material of the unitary member and because of its inherent resiliency, permits the clip to pivot or swing about the hinge and in cooperation with the torsion spring 53 brings the clip back to a position where the engaging surface 64 will engage the mounting surface 23 of the clipboard.

Figure 4:
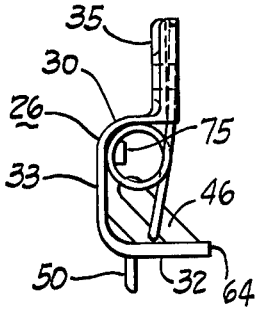
FIG. 4 is a view taken from the right edge of FIG. 3.
Figure 5:
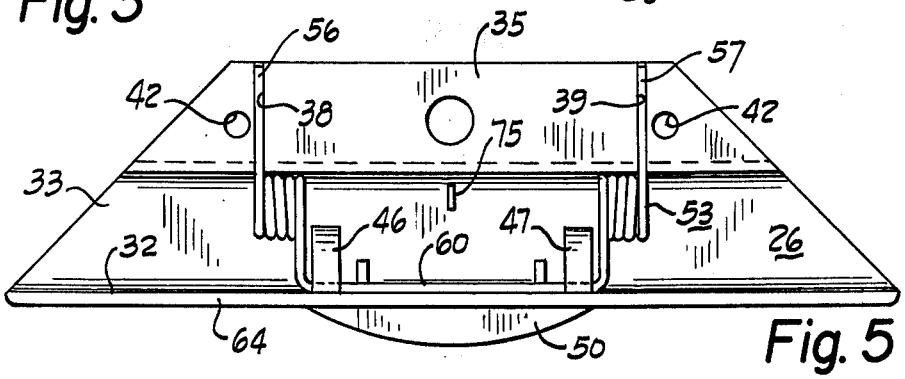
FIG. 5 is an enlarged bottom plan view of the clip of the present invention.

FIGS. 4 and 6 of the drawings illustrate the molded and unattached configuration or condition of the clip 26. It will be noted that the engaging surface 64 of the unitary member in this condition or in its molded condition, is located a greater distance 70 from the connecting portion 33 than the distance 72 the mounting wall is located from the connecting portion 33. When the clip is secured to the clipboard as illustrated in FIG. 7 and the engaging surface and the mounting wall both lie on the mounting surface 23, a force is created tending to hold the engaging surface securely against the mounting surface. This force is created not only because of the molded configuration of the clip, but because the movement of the components in mounting the clip on the surface and getting it into the configuration of FIG. 7, tends to preload the torsion spring to additionally assist in providing the correct tension of the engaging surface against articles held on the mounting surface of the clipboard.

The mounting of the clip 26 to the clipboard 20 has been described hereinabove and FIG. 8 illustrates the position of the clip when the lifting member 50 has been grasped by one using the clipboard to lift the second side 32 to the position shown with the clip swinging about the hinge 68. This is normally done to either remove papers held by the clipboard or to place papers in position to be held on the clipboard.

It will be apparent that the disclosure contained in the above description and in the drawings has provided a new and convenient one-piece plastic clip member which is susceptible of convenient mass production and because of its simplicity and the fact it can be mass produced, provides a clip which can be very economically produced. The configuration of the plastic clip produces a convenient U-shape within which to house the double torsion spring which assists in providing the proper amount of tension to hold papers on the surface of the clipboard. The molded and unattached position of the clip as described hereinabove in conjunction with the design of the living hinge also, conveniently assists in providing the proper tension to hold articles on the clipboard.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. The combination of a clipboard having a mounting surface and a plastic clip secured to the mounting surface, said clip including a one-piece unitary member having first and second sides and a connecting portion defining a generally U-shaped cross sectional configuration, a mounting wall extending laterally outwardly from said first side and having first and second spaced spring retaining grooves extending transversely thereacross, wall means defining spaced openings through said mounting wall with securing members extending therethrough to secure said clip to said mounting surface, first and second spaced spring retaining lugs formed on said second side of said unitary member, a lifting member on the outside of said second side of said unitary member to enable a user of the combination to lift said clip, a torsion spring residing within said U-shape of said unitary member and having first and second free ends and an interconnecting portion, said first and second free ends respectively residing is said first and second spring retaining grooves and held therein by the mounting surface of said clipboard, said interconnecting portion of said spring being secured by said first and second spring retaining lugs, said second side of said unitary member having an engaging surface to hold paper on said mounting surface of said clipboard, said unitary member between said mounting wall and said first side being thinner than at other places so as to permit flexing of the unitary member at this position during operation of the clip, said engaging surface of said unitary member in its molded condition being a greater distance from said connecting portion than said mounting wall whereby when said clip is secured to said clipboard and said engaging surface and said mounting wall both lie on the same surface a force is created tending to hold said engaging surface against said mounting surface.

2. A clip for use with a clipboard comprising a unitary one-piece member constructed of plastic material, said member having first and second side portions connected by a connecting portion and forming in cross section a generally U-shaped configuration, a mounting wall integrally connected to and extending laterally outwardly from the end of said first side portion and having means for attaching the same to a clipboard, wall means on said member for carrying a spring member within said U-shape, said second side portion having an engaging surface on the end thereof for holding papers and the like on a clipboard when the clip is attached to a clipboard.

3. A clip as claimed in claim 2, wherein spring retaining groove means are provided in said mounting wall spring retaining lug means are provided on said second side portion, a torsion spring residing within said U-shape with a portion thereof residing in said spring retaining groove means and a portion engaging said retaining lug means.

4. A clip as claimed in claim 2, wherein said unitary one-piece member in its molded condition is of such configuration that said mounting wall is located closer to said connecting portion than said engaging surface is located to said connecting portion, and when said unitary one-piece member is secured to a clipboard said mounting wall and said engaging surface both lie in the same plane.

5. A clip as claimed in claim 3, wherein said unitary one-piece member in its molded condition is of such configuration that said mounting wall is located closer to said connecting portion than said engaging surface is located to said connecting portion and when said unitary one-piece member is secured to a clipboard said mounting wall and said engaging surface both lie in the same plane.

6. A clip as claimed in claim 2, wherein said unitary one-piece member is provided with a thin wall section between said mounting wall and said first side portion to permit relative movement between the two at said thin wall section.

7. A clip as claimed in claim 3, wherein said groove means have an entranceway which is smaller than said groove means to prevent removal of said portion of said spring which resides in said groove means.

* * * * *